US009221655B2

(12) United States Patent
Kouhia

(10) Patent No.: US 9,221,655 B2
(45) Date of Patent: Dec. 29, 2015

(54) SYSTEM USED WITH A CRANE FOR INDICATING AND MEASURING THE POSITION OF A CONTAINER IN A VEHICLE AND/OR TRAILER LOADED WITH CONTAINERS

(71) Applicant: CARGOTEC FINLAND OY, Tampere (FI)

(72) Inventor: Jyrki Kouhia, Julkujärvi (FI)

(73) Assignee: CARGOTEC FINLAND OY, Tampere (FI)

( * ) Notice: Subject to any disclaimer, the term of this patent is extended or adjusted under 35 U.S.C. 154(b) by 22 days.

(21) Appl. No.: 14/360,027

(22) PCT Filed: Nov. 19, 2012

(86) PCT No.: PCT/FI2012/051139

§ 371 (c)(1),
(2) Date: May 22, 2014

(87) PCT Pub. No.: WO2013/076366

PCT Pub. Date: May 30, 2013

(65) Prior Publication Data

US 2014/0285330 A1 Sep. 25, 2014

(30) Foreign Application Priority Data

Nov. 22, 2011 (FI) ..... 20116159

(51) Int. Cl.
*G08B 21/00* (2006.01)
*B66C 13/46* (2006.01)
*B66C 19/00* (2006.01)

(52) U.S. Cl.
CPC ..... *B66C 13/46* (2013.01); *B66C 19/002* (2013.01)

(58) Field of Classification Search
CPC ..... B66C 13/46; B66C 19/002
USPC ..... 340/425.5, 685; 414/373; 212/276, 319; 294/81.4
See application file for complete search history.

(56) References Cited

U.S. PATENT DOCUMENTS 4,139,107 A 2/1979 Ninomiya et al.

FOREIGN PATENT DOCUMENTS

CN 1884034 A 12/2006
DE 2609849 A1 10/1976
DE 3445830 A1 6/1986

(Continued)

OTHER PUBLICATIONS

PCT/ISA/210—International Search Report—Apr. 25, 2013 (Issued in PCT/FI2012/051139).

(Continued)

*Primary Examiner* — Jeffery Hofsass

(74) *Attorney, Agent, or Firm* — Venable LLP; Eric J. Franklin

(57) ABSTRACT

A system for determining the position of at least one container in a vehicle and/or trailer in a container loading area. The at least one container is loaded and unloaded on the vehicle and/or trailer by a crane. The crane includes a spreader grabbing the containers from a top and a positioning system for the crane and the spreader. A container position determining apparatus is arranged in connection with the at least one lane and includes a fixed structure mounted alongside the at least one lane in a known location relative to the ground. An indicator is movable on the fixed structure and can be manually moved to indicate either end of a desired position of a container on a vehicle parked on the lane or on a trailer connected thereto. Information about the position of the indicator on the fixed structure is determined and transmitted to the crane.

7 Claims, 3 Drawing Sheets

(56) References Cited

FOREIGN PATENT DOCUMENTS

| | | | |
|---|---|---|---|
| DE | 3606363 | A1 | 9/1987 |
| GB | 2425520 | A | 11/2006 |
| WO | WO-02/34663 | A1 | 5/2002 |

OTHER PUBLICATIONS

PCT/ISA/237—Written Opinion of the International Searching Authority—Apr. 25, 2013 (Issued in PCT/FI2012/051139).

Search Report—Sep. 14, 2012 (Issued in Finnish Priority Application No. 20116159).

SYSTEM USED WITH A CRANE FOR INDICATING AND MEASURING THE POSITION OF A CONTAINER IN A VEHICLE AND/OR TRAILER LOADED WITH CONTAINERS

CROSS-REFERENCE TO RELATED APPLICATIONS

This application claims priority to Finnish patent application 20116159 filed 22 Nov. 2011 and is the national phase of PCT/FI2012/051139 filed 19 Nov. 2012.

TECHNICAL FIELD

The invention relates to the loading of containers on road transportation vehicles, in particular trailer trucks designated for the transportation of containers, and to the unloading of containers therefrom. In more detail, the invention relates to a system for determining the position of a container in a vehicle and/or trailer loaded with containers in a container loading area, such as container terminal, for loading and unloading the container or containers on or from the vehicle and/or trailer, respectively, by a crane handling the containers and moving over a lane or lanes in the loading area, the crane provided with a spreader grabbing the containers from the top and with a positioning system for the crane and the spreader, the system for determining the position of a container being provided with a container position determining apparatus arranged in connection with the lane.

TECHNICAL BACKGROUND

Loading and unloading of road trailer trucks transporting containers is an important part of the operations in nearly all container terminals. As a function, the unloading of trailer trucks does not differ much from a situation where the container is picked up in the container storage area, as in both cases an unladen spreader is lowered on top of the container, after which the container is locked to the spreader by means of twistlocks.

In automatic container crane systems, the container can be automatically lifted from a trailer truck for example by means of measuring systems based on laser scanners. Systems have also been developed for loading the containers on a trailer automatically. An absolutely essential requirement for these systems is, however, that the desired position of the container can be accurately measured. However, accurate measurement requires reference points that can be identified. In most terminals, unloading and/or loading of trailer trucks is, nevertheless, a manual procedure due to security regulations.

The loading of trailer trucks is considerably more challenging than the unloading. The trailer in road trailer trucks transporting containers is usually provided with twistlocks, by means of which it is ensured that the container stays in place during the transportation. Lowering the container with sufficient accuracy in such a way as to align corner castings of the lowered container sufficiently accurately with the twistlocks requires accuracy. The visibility of the crane operator is disturbed by the container hanging from the spreader and blocking the twistlocks in the truck at the final stage of the lowering process.

Handling of the trailers is facilitated by a variety of systems. For example, there are systems where the driver of a truck is assisted in stopping relative to the crane by means of a measuring system based on a laser scanner in such a way that the main movements of the crane would not have to be operated. By the main movements is meant the movement of the entire gantry or trolley.

An example of state of the art solutions representing laser scanner technology is patent publication CN201161875Y disclosing a system for determining locations of a spreader in a container crane and of a trailer truck to be loaded or unloaded, and particularly of twistlocks on a bed thereof (or of corner castings in a container) relative to the crane. Information produced by laser scanners in the system also allows one to conclude the type of a truck to be loaded and/or of a container to be lifted out from a truck.

Another example of solutions utilizing the laser scanner technology is disclosed in patent publication CN1884034A relating to a system for determining locations of a trailer truck loaded or unloaded by a container crane and of the containers on a bed thereof relative to the crane. Information produced by laser scanners in the system also allows one to conclude the type of a truck to be loaded and/or of a container to be lifted out from a truck.

A third example of solutions representing this technology is patent publication JP2005239343A relating to a system for determining locations of trailer trucks to be loaded or unloaded relative to a crane handling containers. The system uses laser scanners disposed on the frame of the crane.

A container can be automatically lifted from a trailer truck for example by means of the measuring systems based on laser scanners.

There are also systems based on cameras, wherein the aim is to recognize the desired position of the container of twistlocks in the trailer utilizing machine vision. One such solution is disclosed in patent publication DE3606363A1 relating to a system for determining the location of a trailer truck to be loaded or unloaded relative to a crane handling containers. The system uses cameras disposed on the frame of the crane at a height of a bed in the trailer truck. A problem of the camera-based machine vision systems is moderate reliability due to environmental conditions. In particular, wrong interpretations are caused by lighting that changes. When directing a spreader of a crane based on information from a measuring system, reliability is extremely important. False measurement data may cause material damages.

Yet another example of known state of the art is patent publication EP1337454A1, wherein a system for determining the location of a trailer truck to be loaded or unloaded relative to a crane handling containers is disclosed. The system uses sensors disposed on the frame of the crane at a height of a bed in the trailer truck.

However, not all trailers have measurable reference points, such as twistlocks; instead, cargo is fastened to the trailer e.g. by tie down straps or chains. In addition, the twistlocks in some trailers are not exposed until points for the fastening of a container are subjected to the weight of the container.

SUMMARY OF THE INVENTION

The objective of the present invention is to provide a novel solution for indicating and measuring the position of a container in a vehicle and/or trailer loaded with containers. To this end, the invention is mainly characterized in that a container position determining apparatus comprises a fixed structure which is mounted alongside a lane and the location of which relative to ground is known, and an indicator that is movable on the fixed structure and can be moved manually to indicate either end of the desired position of the container on the vehicle parked on the lane or on the trailer connected thereto, whereupon information about the position of the indicator on the fixed structure is determined and transmitted to a crane.

The fixed structure mounted alongside the lane is preferably an elongated rail parallel to the lane or the like, along which the indicator is movable. One or more sensors are appropriately provided in connection with the indicator or in the fixed structure to determine the position of the indicator on the fixed structure.

Alternatively, the position of the indicator on the fixed structure can also be determined by the positioning and measuring systems of the crane.

To improve the measuring accuracy, the indicator may be provided with a mechanical accessory part extending out from the indicator to the lane to reduce distance to a vehicle parked on the lane and/or to a trailer connected thereto. Said accessory part may in this case be formed as a fixed part of the actual indicator.

Alternatively, the indicator may be provided with a laser sight or suchlike laser light emitting a visible laser line, the laser line being pointed out from the indicator to the lane and a parked vehicle or a trailer connected thereto.

The invention provides considerable advantages as compared to prior art. By the system according to the invention, the position of cargo, particularly of a container, on a trailer can be indicated and determined also when the trailer has no measurable reference points, such as twistlocks. Measuring the position of a container accurately on the trailer of a truck is generally quite difficult, and the good measuring systems are expensive. In state of the art solutions, all cases cannot even be measured accurately because there are no reference points in the target area. To indicate and determine the position of a container, the invention provides an economic and reliable method which is mainly based on operations of the driver and on manual use. Thus, the driver is always able to supervise that determination of the position of a container is correctly performed.

Other advantages and characteristics of the invention are set out below by detailed disclosure of the invention, wherein the invention is described with reference to the figures of the accompanying drawing, to the details of which the invention is not exclusively limited.

SHORT DESCRIPTION OF THE FIGURES

FIG. 1 schematically illustrates a container crane which is used in a port and in connection with which the system according to the invention is applicable.

FIG. 2 schematically illustrates a gantry crane which is used in a container terminal and in connection with which the system according to the invention is also applicable.

FIG. 3 schematically illustrates a front view, seen from the incoming direction of vehicles, of an automatic stacking crane which is used in a container terminal and in connection with which the system according to the invention is applicable.

DETAILED DESCRIPTION OF PREFERRED EMBODIMENTS

Figure 1:
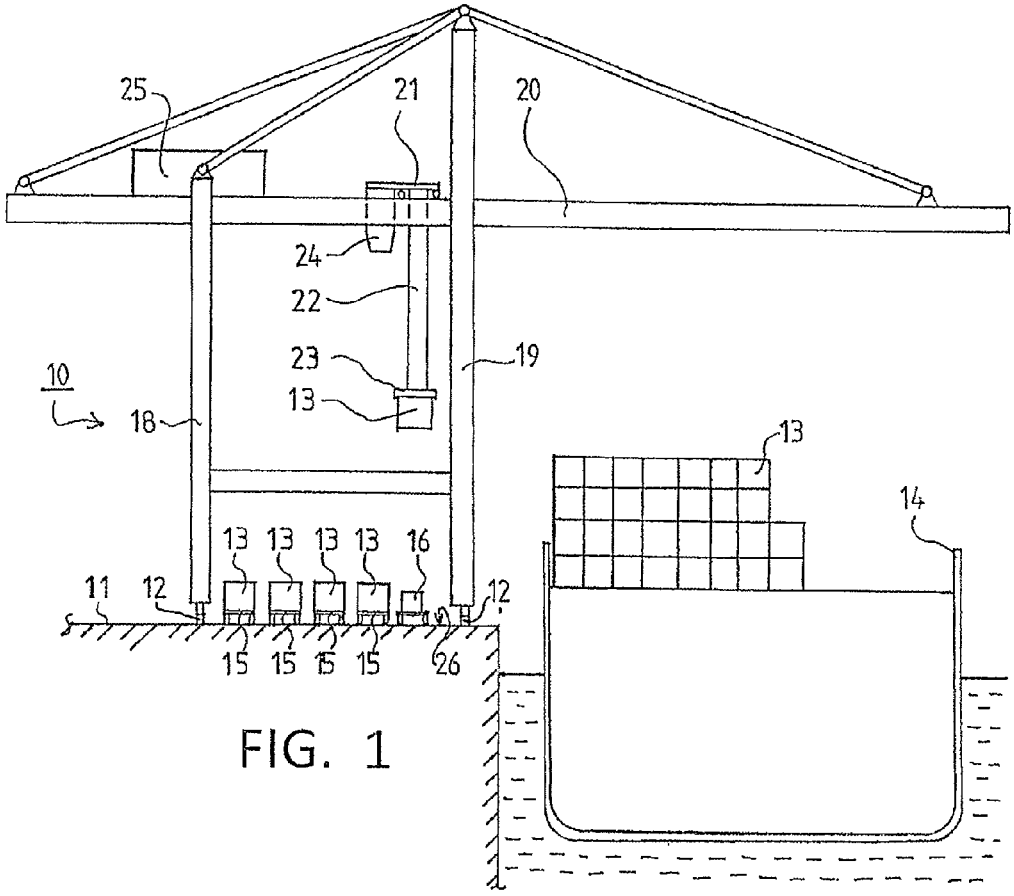

FIG. 1 of the drawing schematically illustrates, by way of example, a side view of a container crane, in connection with which the system according to the invention is applicable. In FIG. 1, the container crane is generally referenced as number 10 and it is of the so-called STS (Ship-to-Shore) crane type arranged on a quay 11 to move along rails 12. The container crane 10 is arranged to move containers 13 from a container ship 14 onto transportation beds 15 or suchlike trailers 17 pulled by a vehicle 16 and vice versa during loading of the ship 14 and unloading of cargo. The container crane 10 is provided with a vertical frame that comprises legs 18, 19 and supports a horizontal boom 20, along which a trolley 21 is adapted to move. The trolley 21 carries, by means of hoisting ropes 22, a spreader 23 grabbing the container 13 from the top. An operator's cabin connected to the trolley 21 is referenced as number 24 and an electrical power machinery of the crane is referenced as number 25. Under the crane, there are lanes 26, along which vehicle-trailer combinations drive under the crane to move containers 13 from the trailer to the container ship 14 or vice versa.

Figure 2:
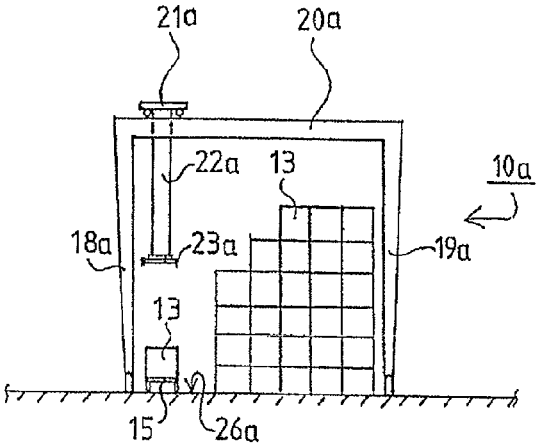

FIG. 2 schematically illustrates a gantry crane 10*a* which is used in the container terminal and in connection with which the system according to the invention is also applicable. The gantry crane 10*a* may be a rail mounted gantry crane (RMG) or, as illustrated in FIG. 2, a rubber tyred gantry crane (RTG). The gantry crane 10*a* is designated to move containers 13 from transportation beds 15 or suchlike trailers pulled by a vehicle and stack the containers 13 in rows in the container yard and vice versa. The gantry crane 10*a* is provided with a vertical frame that comprises legs 18*a*, 19*a* and supports a horizontal bridge 20*a*, along which a trolley 21*a* is adapted to move. The trolley 21*a* carries, by means of hoisting ropes 22*a*, a spreader 23*a* grabbing a container 13 from the top. The container rows are disposed between the legs 18*a*, 19*a* of the gantry crane 10*a*, and between the legs there is also a lane 26*a*, along which vehicle-trailer combinations drive under the crane to move containers 13 from the trailer to the container rows or vice versa.

Figure 3:
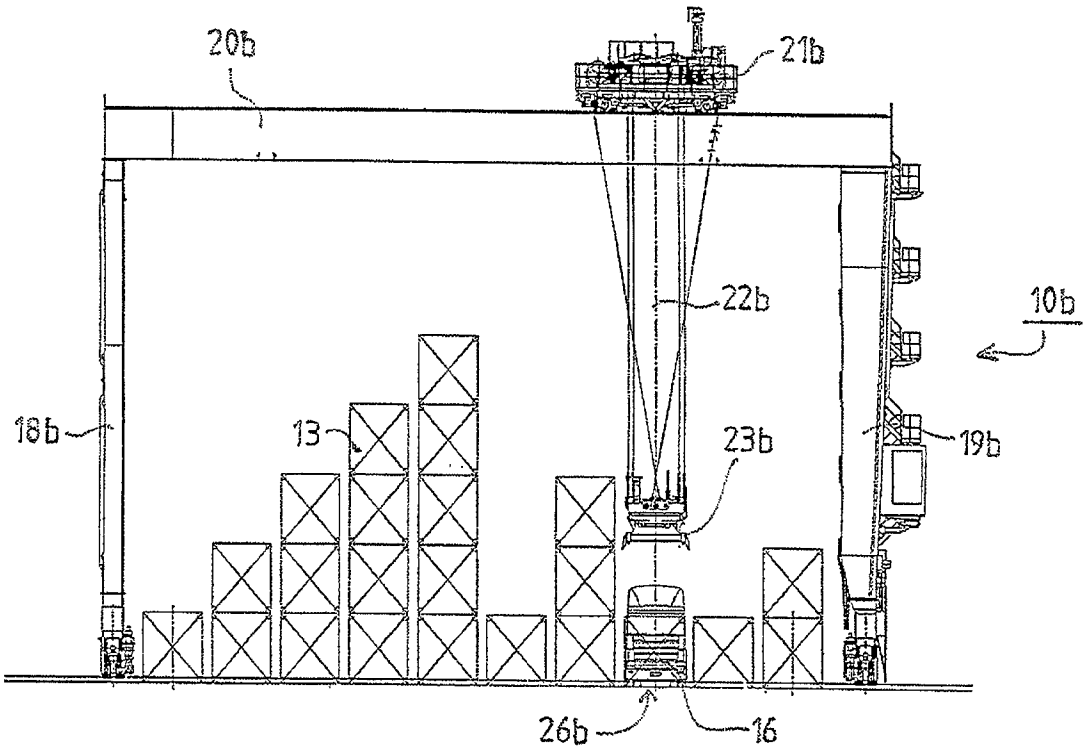

FIG. 3 schematically illustrates an automatic stacking crane 10*b* (ASC) which is used in the container terminal and in connection with which the system according to the invention is also applicable. In structural terms, the automatic stacking crane 10*b* is similar to the gantry crane 10*a* of FIG. 2 and it is, in the corresponding manner, designated to move containers 13 from vehicles 16 and trailers 17 pulled thereby and stack the containers 13 in container rows in the container yard and vice versa. The crane 10*b* according to FIG. 3 is designed to operate automatically, i.e. without an operator. The structure of the automatic stacking crane 10*b* is thus for the most part similar to the gantry crane 10*a* of FIG. 2, and it is hence provided with a vertical frame that comprises legs 18*b*, 19*b* and supports a horizontal bridge 20*b*, along which a trolley 21*b* is adapted to move. The trolley 21*b* carries, by means of hoisting ropes 22*b*, a spreader 23*b* grabbing a container 13 from the top. The automatic stacking crane 10*b* of FIGS. 3 and 4 operates e.g. in the container terminal or, respectively, in the port in the landside interchange area (LS) provided with lanes 26*b* for vehicles 16 and trailers 17. This area comprising the lanes 12*b* functions as the loading area, particularly in the case of FIG. 3 as an automated loading area, where the loading and unloading of the containers takes place. Rows formed by the containers 13 as well as the lanes 26*b* are disposed between the legs 18*b*, 19*b* of the crane 10*b*.

Figure 4:
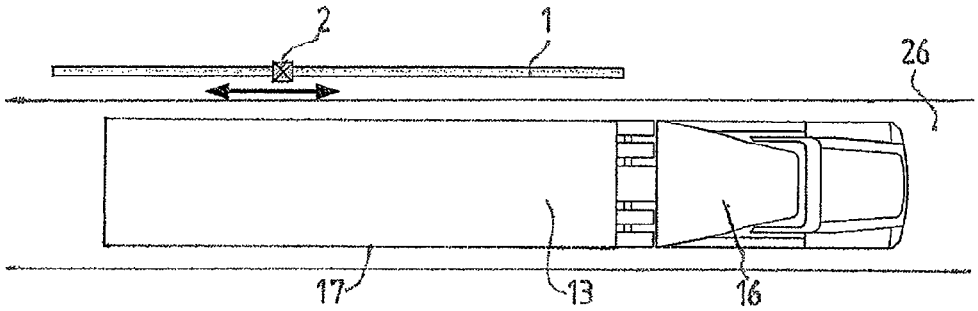
FIG. 4 illustrates one embodiment of the system according to the invention as a schematic top view.

In a situation illustrated in FIG. 4, a vehicle 16 and its trailer 17 have been driven or reversed onto the free lane 26 and parked to load or unload the container 13 onto or from the trailer 17. In the system according to the invention, in connection with the lane 26 there is provided a container position determining apparatus which comprises an elongated fixed structure 1, e.g. a rail or the like, which is mounted alongside the lane 26 in parallel to the lane 26 and the location of which relative to ground is thus accurately known. The fixed structure 1 is further mounted with an indicator 2 that is movable along the structure in the longitudinal direction. When a vehicle 16 with a trailer 17 is parked, the driver of the vehicle manually moves the indicator 2 to indicate either end of the desired position of a container. Thus, the position of a container does not depend on the type of the vehicle 16 or the trailer 17 and succeeding of measurement does not depend on reference points which can be detected in the trailer 17.

Location of the indicator 2 on the fixed structure 1, such as a rail, is determined and this location information is transmitted to the crane 10, 10*a*, 10*b*. Position of the crane relative to ground is determined by other measuring systems which may be present on the actual crane 10, 10*a*, 10*b* or external to the crane. Accurate determination of location of the indicator 2 can be performed e.g. by a sensor solution comprising one or more sensors provided in connection with the indicator 2 or in the fixed structure 1. The location of the indicator 2 can also be determined by measuring systems present in the crane 10, 10*a*, 10*b*, in which case the position of a container can be determined directly relative to the crane or relative to ground if desired.

Figure 5:
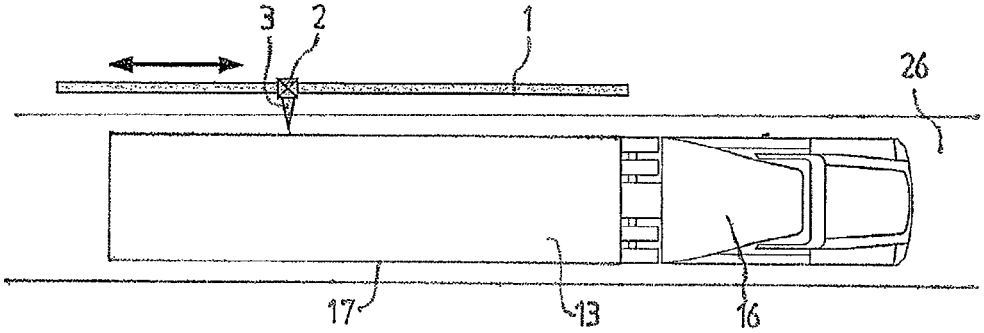
FIG. 5 shows an illustration of another embodiment of the system according to the invention corresponding to FIG. 4.

To improve and facilitate the determination of the position of a container, the indicator 2 in the system according to FIG. 5 may be provided with a mechanical accessory part 3 which extends from the indicator 2 and, as the indictor 2 is being moved, moves in proximity to the trailer 17 for sufficient accuracy. Said accessory part 3 thus extends from the indicator 2 to the lane 26 in such a way that distance between the accessory part 3 and the trailer 17 is sufficiently small. The accessory part 3 may also be formed as a fixed part of the actual indicator 2.

Figure 6:
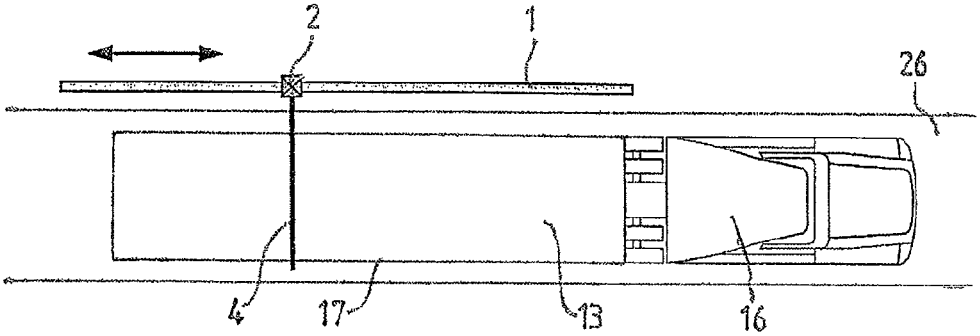
FIG. 6 shows an illustration of yet another embodiment of the invention corresponding to FIGS. 4 and 5.

Another solution improving accuracy of the indicator 2 is illustrated in FIG. 6. In this embodiment, the indicator 2 is provided with a laser sight or suchlike laser light emitting a visible laser line 4. The laser line 4 is pointed out from the indicator 2 to the lane 26. The position of a container or actually the end of the position of a container can be determined very accurately by this solution.

It is essential and common for different embodiments of the invention to perform the determination of the position of a container by means of a fixed structure 1, such as a rail, and an indicator 2 moving thereon manually, chiefly by driver of the vehicle 16.

The invention has been described above by way of example with reference to the figures of the accompanying drawing. The invention is not, however, limited merely to the examples illustrated in the figures; instead, different embodiments of the invention may vary within the scope of the inventive idea defined in the accompanying claims.

The invention claimed is:

1. A system for determining the position of a container in a vehicle and/or trailer loaded with containers in a loading area for containers, the container or containers being loaded on the vehicle and/or trailer and correspondingly unloaded therefrom by a crane handling containers, moving over a lane or lanes in the loading area and comprising a spreader grabbing the containers from a top, and with a positioning system for the crane and the spreader, the system for determining the position of a container comprising:

a container position determining apparatus arranged in connection with the lane, wherein the container position determining apparatus comprises a fixed structure which is mounted alongside the lane and a location of which relative to ground is known, and an indicator that is movable on the fixed structure and can be manually moved to indicate either end of a desired position of a container on a vehicle parked on the lane or on a trailer connected thereto, whereupon information about a position of the indicator on the fixed structure is determined and transmitted to the crane.

2. The system according to claim 1, wherein the fixed structure mounted alongside the lane is an elongated rail parallel to the lane, along which the indicator is movable.

3. The system according to claim 1, wherein one or more sensors have been provided in connection with the indicator or in the fixed structure to determine the position of the indicator on the fixed structure.

4. The system according to claim 1, wherein the position of the indicator on the fixed structure is arranged to be determined by the positioning and measuring systems of the crane.

5. The system according to claim 1, wherein the indicator comprises a mechanical accessory part extending out from the indicator to the lane to reduce a distance to a vehicle parked on the lane and/or to a trailer connected thereto.

6. The system according to claim 5, wherein the accessory part is formed as a fixed part of the actual indicator.

7. The system according to claim 1, wherein the indicator comprises a laser sight or laser light emitting a visible laser line, the laser line being pointed out from the indicator to the lane and a vehicle parked thereon or a trailer connected to the vehicle.

* * * * *